US006397401B2

(12) United States Patent
Belcher

(10) Patent No.: US 6,397,401 B2
(45) Date of Patent: Jun. 4, 2002

(54) 2-LAYER FIREFIGHTER GARMENT

(76) Inventor: Timothy A. Belcher, 122 Belcher Rd., Charleston, WV (US) 25311

( * ) Notice: Subject to any disclaimer, the term of this patent is extended or adjusted under 35 U.S.C. 154(b) by 0 days.

(21) Appl. No.: 09/847,082

(22) Filed: May 2, 2001

Related U.S. Application Data

(60) Provisional application No. 60/201,354, filed on May 2, 2000.

(51) Int. Cl.[7] ..... A62B 17/00

(52) U.S. Cl. ..... 2/458; 2/81; 2/82; 2/97

(58) Field of Search ..... 2/458, 81, 82, 2/97

(56) References Cited

U.S. PATENT DOCUMENTS 5,468,537 A * 11/1995 Brown et al. ..... 428/101
5,640,718 A 6/1997 Aldridge ..... 2/81
5,701,606 A * 12/1997 Aldridge ..... 2/458
5,720,045 A * 2/1998 Aldridge ..... 2/458
5,920,905 A * 7/1999 Aldridge ..... 2/458
5,924,134 A * 7/1999 Taylor et al. ..... 2/458
6,192,520 B1 * 2/2001 Underwood et al. ..... 2/458

* cited by examiner

*Primary Examiner*—John J. Calvert
*Assistant Examiner*—Robert H. Muromoto, Jr.
(74) *Attorney, Agent, or Firm*—Steptoe & Johnson PLLC

(57) ABSTRACT

A two layer garment system having an outer layer and a trilaminate inner layer sewn together is used to manufacture fire retardant, or firefighting, textile products, e.g., jackets, pants, gloves, bags and totes. The layers of the trilaminate inner liner insulate, water proof, and provide a face cloth for the firefighting textile product. In the preferred embodiment, the outer layer comprises a woven melamine paraaramid fiber blend blend having a density of about 7.5 ounces per square yard. The inner liner comprises three layers laminated together. A first layer of the inner liner for insulating the firefighting textile product comprises about 6 ounces per square yard of melamine aramid fiber blend knit. A second layer of the inner liner for water proofing the firefighting textile product comprises a commercially available, vapor-permeable moisture membrane material,. The third layer of the inner liner for providing a face cloth for the firefighting textile product comprises about 2 ounces per square yard of aramid knit. The two layer garment system results in a fire retardant fabric having a thermal protective performance rating of about 35 or higher.

20 Claims, 1 Drawing Sheet

2-LAYER FIREFIGHTER GARMENT

This application claims benefit to U.S. provisional application Ser. No. 60/201,354, filed May 2, 2000.

BACKGROUND OF THE INVENTION

1. Field of Technology

This invention relates to fire fighting garments, and more specifically, to a two layer garment system that combines a Basofil outer layer with a trilaminate inner liner.

2. Related Art

A firefighter garment must withstand severe conditions of heat and moisture in order to protect the wearer. Accordingly, the National Fire Protection Association ("NFPA") has established many standards for firefighter garments to ensure the safety of firefighters and emergency first responders. For example, a firefighter garment must have a thermal protective performance ("TPP") of at least thirty five (35) and all components of the firefighter garment must be fire retardant.

Conventional firefighter garments have an outer shell and an inner liner. The inner liner has two layers: (1) a moisture barrier layer being a bilaminate of a moisture barrier fabric, e.g., GORE-TEX® by W. L. Gore & Associates, Inc., and a stiffening fabric, and (2) a quilted thermal layer made of two to four layers of material. These two layers of the inner liner are sewn together into a single inner liner and the seams are sealed with tape to prevent any leakage through the stitching holes. In constructing a firefighting garment, the outer shell and the inner liner are each made into the desired firefighting garment, such that the inner liner is mechanically fastened, e.g., zippers, buttons, snaps, or clasps, inside the outer liner with the quilted thermal layer being closest to the wearer. The inner liner is made as a separate garment to facilitate its removal from the garment for cleaning.

There are several disadvantages with conventional firefighting garments. First, because the quilted thermal layer typically lays closest to the wearer's body, it impedes transport of moisture vapor, i.e., sweat, from the wearer's skin until it can pass through the breathable moisture barrier layer. This sweating process is the primary cooling mechanism for the human body and any reduction of this process has serious, and potentially fatal, consequences. An increase of breathable levels of a firefighting garment, which means the ability of a garment to transfer the heat laden sweat vapor from the skin to the air outside the garment, is a vital concern. Second, the quilted thermal layer of the inner liner tends to become very heavy and contaminated with germs and bacteria as it holds moisture and sweat from the wearer. Third, once laden with moisture, the quilted thermal layer does not breathe very easily. Fourth, manufacturing of a firefighting garment is costly and time consuming due to the separate manufacturing of the outer shell and the inner liner and the need to mechanically fasten these two together.

While single layer trilaminates have been successfully in use for some time as protective garments, and specifically as rainwear, the use of a trilaminate material as an inner liner in conjunction with an outer layer, thereby creating a two layer firefighting garment, has not been produced. Therefore, there is a need for a firefighter garment that is light-weight and allows moisture to "breathe" through the garment layers. There is a further need for a firefighter garment that provides the necessary thermal layer while eliminating the need for quilting of multiple layers of fabric.

In about 1997, W. L. Gore & Associates, Inc. began promoting a new trilaminate fabric called Crosstech S/R which was intended to meet the Federal Emergency Management Authority ("FEMA") requirements for search and rescue and be a high performance single-layer garment. This trilaminate fabric has a TPP rating of twenty-one (21). The disadvantage with the Crosstech S/R trilaminate fabric is that it is very expensive, thereby making it not economically feasible to incorporate the Crosstech S/R fabric into firefighter garments. Other less expensive trilaminate fabrics, e.g., Nomex, are available. However, the TPP ratings of such trilaminates are much lower than that of Crosstech S/R due to the thermal decomposition of the fabric. Specifically, these cheaper trilaminates have premature moisture membrane failure at high temperatures, thereby making it unsafe to use these trilaminates in a firefighter garment.

Therefore, there is a need for a relatively inexpensive and light-weight trilaminate fabric having the higher thermal stability needed for a firefighting garment.

In its continuous desire to provide better firefighting garments, BASF company began developing a fabric called Basofil that typically displays a higher TPP rating than competitive or comparable fabrics. Basofil fabrics have high insulation values due to their nonconductive nature and display endothermic or heat absorbing characteristics during thermal decomposition.

Therefore, there is a need for a light-weight fabric that uses Basofil, or a comparable fabric, in both the outer shell and the inner liner layers, thereby maximizing the TPP of the resulting fabric while maintaining its light weight and moisture barrier qualities.

In U.S. Pat. No. 5,640,718 to Aldridge ("the Aldridge Patent"), a fire fighter garment is disclosed having an outer layer and an inner liner, wherein the inner liner is two layers with the thermal layer (which is against the wearer in conventional garments) repositioned to be closest to the outer layer and the moisture barrier layer is against the wearer. The moisture barrier layer is laminated with a face cloth that is to be worn directly against the wearer. The thermal layer is also a bilaminate of quilted fabrics and a foam layer.

The principal disadvantage with the Aldridge Patent is that it uses an inner liner having a laminated foam thermal layer. Therefore, this construction retains the bulk associated with conventional fire fighting garments. In addition, although repositioning the moisture barrier layer to the inner layer next to the wearer facilitates the garment's breathing, this effort is defeated by the use of closed cell foam in the thermal layer which is non-vapor permeable. Efforts to increase breathability by aperturing the foam is only marginally effective as tests have shown. However, in this configuration a trilaminate is not used in the finished firefighting garment. The moisture barrier layer fulfills the role of face cloth but is still in bilaminate form.

SUMMARY OF THE INVENTION

The present invention solves the problems associated with conventional firefighting garments and textile products by using a two layer garment system having an outer layer and an inner liner. The outer layer contains a Basofil blend and the inner layer is a trilaminate comprised of a means for insulating, a means for water proofing, and a means for providing a face cloth. In the preferred embodiment, the means for insulating is a layer containing a Basofil blend knit laminated to the means for water proofing; the means for water proofing contains a commercially available moisture membrane, e.g, GORE-TEX® or Stedair 2000®, laminated to the means for providing a face cloth, and the means for providing a face cloth contains a Nomex knit. Once the inner liner is made, it is sewn into an outer shell of a firefighting garment. Finally, all construction seams of the final firefighting garment are sealed according to manufacturers' guidelines to maintain the moisture integrity of the garment.

There are many advantages with the two layer garment system of the present invention. A garment employing the present invention is thinner and less bulky than conventional firefighting garments because of the elimination of a quilted inner liner. Also, such a garment can be lighter than conventional garments in construction, and also in use, in as much as it has much less moisture weight gain potential over conventional composites. Most importantly, a firefighting garment employing the present invention has a TPP rating of at least 35.

Due to the construction necessities, conventional firefighting garments have layers that are typically snapped or zipped together. It is this mechanical joining of layers that also adds weight, as well as bulk, to such a garment. In manufacturing, a conventional garment is made as two pieces that are later joined together, thereby adding to the manufacturing time and cost of the garment. By simplifying construction and eliminating the mechanical interfacing of conventional garments, the present invention saves both time and expense because a firefighting garment can be manufactured as a single unit.

The two layer garment system of the present invention also increases the breathability of the resulting garment because the moisture membrane in the inner layer is positioned closer to the wearer. In addition, with the elimination of the thermal layer, better breathability is achieved because there is no absorption of excess water. Lastly, the means for insulating the inner layer of the present invention does not depend on a lofted or batting material which can be compressed or lost upon extended use. Therefore, the two layer garment system of the present invention will not have a loss of insulation levels.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
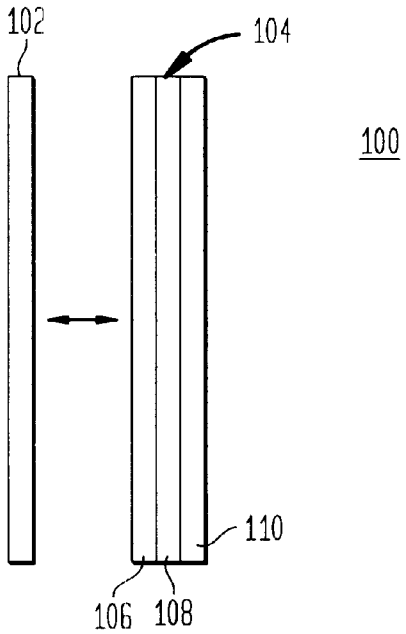
FIG. 1 is a planar side view of a two layer garment system of the present invention.
Figure 2:
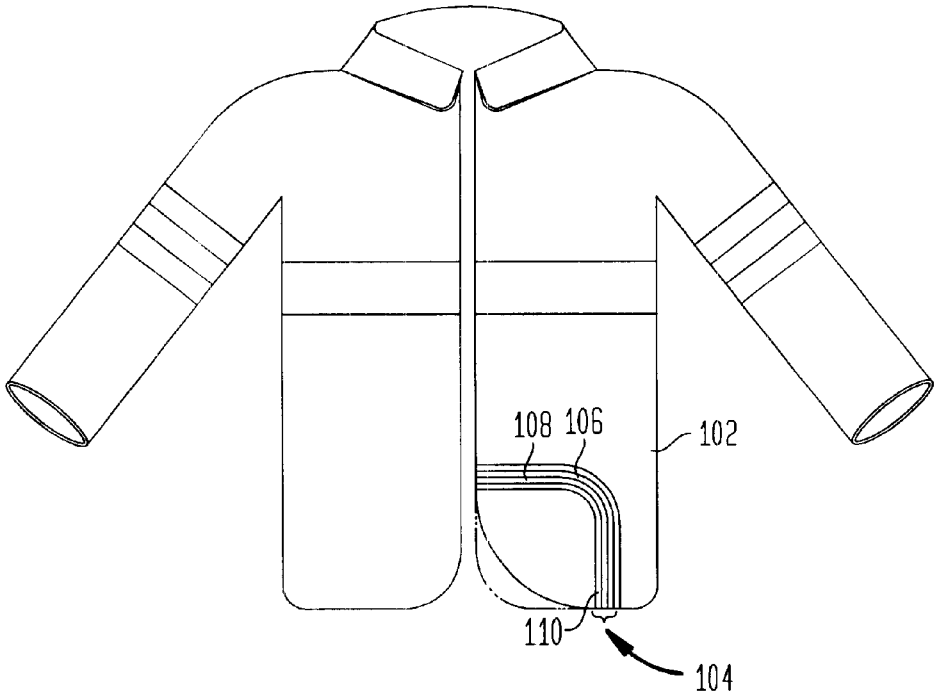
FIG. 2 is a perspective view of a firefighting garment using the 2-layer garment system of the present invention.

The present invention is shown in FIGS. 1 and 2 as a firefighting garment 200 used by fire fighters, wherein the garment 200 uses a two layer garment system 100. The present invention is described in terms of a firefighting garment 200 for convenience purposes only. It would be readily apparent to one of ordinary skill in the relevant arts to use the two layer garment system 100 of the present invention to make any style of firefighting textile product, such as, pants, jackets, gloves, bags, totes, and the like.

The two layer garment system 100 of the present invention comprises two layers. The first layer is the outer layer 102 of a firefighting garment 200 which in the preferred embodiment is a commercially available seven and one half (7.5) ounces per square yard Basofil blend. The second layer is the inner liner 104 of a firefighting garment 200 and in the preferred embodiment is a trilaminate material having three layers that combine a means for insulating 106 the firefighting garment 200, a means for water proofing 108 the firefighting garment 200, and a means for providing a face cloth 110 to the wearer of the firefighting garment 200.

In the preferred embodiment, the first layer of the inner liner 104 incorporating the means for insulating 106 is a Basofil blend knit, which preferably is a commercially available six (6) ounces per square yard Basofil blend knit. In an alternative embodiment, the means for insulating 106 may be three to four and one half ounces per square yard spun lace, non-woven fabric. The second layer incorporating the means for water proofing 108 is a commercially available moisture membrane, which preferably is Stedair 2000. The third layer incorporating the means for providing a face cloth 110 is a commercially available Nomex knit 110 (preferably, a two (2) ounce per square yard Nomex knit). In addition, a first means for joining is used to join the means for insulating 106 with the means for water proofing 108 and a second means for joining is used to join the means for water proofing 108 with the means for providing a face cloth 110. Also in the preferred embodiment of the inner liner 104, the first means for joining and the second means for joining employ standard laminating procedures.

Once the outer layer 102 and the inner liner 104 are complete, the outer layer 102 is patterned and stitched according to standard sewing practices with the inner liner 104 stitched into the inside of the outer layer 102 such that the layer of the inner liner 104 having the means for providing a face cloth 110 is against the wearer. As per industry standards, seam sealing of all sewn construction points is accomplished on the face cloth side 110 of the inner liner 104 to maintain the moisture integrity of the firefighting garment 200. Seam sealing is performed according to the manufacturer guidelines as established for use on a single layer trilaminate garment currently in use in non-firefighting functions but with fire resistant requirements. Garments currently produced in this manner include those single layer trilaminate garments meeting the requirements for FEMA search and rescue and NFPA emergency medical first responders.

All references to weights and types of materials, e.g., Basofil, Nomex, GORE-TEX®, and Stedair 2000®, are for convenience purpose only. It would be readily apparent to one of ordinary skill in the relevant art to use comparable weights and materials, thereby resulting in a comparable two layer garment system 100 having a comparable TPP rating.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A two layer garment system for a firefighting textile product, comprising:

an outer layer;

an inner liner being a trilaminate incorporating a means for insulating, a means for water proofing, and a means for providing a face cloth; and a means for joining said outer layer with said inner liner such that said outer layer is in contact with said means for insulating of said inner liner and said means for providing a face cloth is closest to a wearer.

2. The two layer garment system according to claim 1, wherein said outer layer comprises a woven melamine para-aramid fiber blend.

3. The two layer garment system according to claim 2, wherein said woven melamine para-aramid fiber blend is about 7.5 ounces per square yard.

4. The two layer garment system according to claim 1, wherein said means for insulating of said inner liner is selected from the group consisting of melamine aramid fiber blend knit and spun lace non-woven fabric.

5. The two layer garment system according to claim 4, wherein said means for insulating of said inner liner comprises about six (6) ounces per square yard of said melamine aramid fiber blend knit.

6. The two layer garment system according to claim 1, wherein said means for water proofing of said inner liner comprises a vapor-permeable, moisture membrane material.

7. The two layer garment system according to claim 1, wherein said means for providing a face cloth of said inner liner comprises an aramid.

8. The two layer garment system according to claim 7, wherein said means for providing a face cloth of said inner liner comprises about two (2) ounces per square yard of aramid knit.

9. The two layer garment system according to claim 1, wherein the two layer garment system has a thermal protective performance rating of about 35 or higher.

10. The two layer garment system according to claim 1, wherein said means for joining said outer layer with said inner liner is stitching, thereby creating one or more construction seams.

11. The two layer garment system according to claim 10, wherein said construction seams are sealed.

12. The two layer garment system according to claim 1, wherein the firefighting textile product is selected from the group consisting of jacket, pants, gloves, bag and tote.

13. A method for manufacturing a firefighting textile product with a two layer garment system, the method comprising the steps of:

a. making an outer layer in the pattern and shape of the firefighting textile product;

b. making an inner liner being a trilaminate incorporating a means for insulating, a means for water proofing, and a means for providing a face cloth; and c. joining said outer layer with said inner liner such that said outer layer is in contact with said means for insulating of said inner liner and said means for providing a face cloth is closest to a wearer.

14. The method according to claim 13, wherein said outer layer comprises woven melamine para-aramid fiber blend.

15. The method according to claim 13, wherein said means for insulating of said inner liner comprises melamine aramid fiber blend knit.

16. The method according to claim 13, wherein said means for water proofing of said inner liner comprises a vapor-permeable, moisture membrane material.

17. The method according to claim 13, wherein said means for providing a face cloth of said inner liner comprises an aramid knit.

18. The method according to claim 13, wherein the firefighting textile product has a thermal protective performance rating of about 35 or higher.

19. The method according to claim 13, wherein said joining of said step (c) comprises stitching said outer layer with said inner liner, thereby creating one or more construction seams.

20. The method according to claim 19, further comprising:

d. sealing said construction seams on said means for providing a face cloth of said inner liner.

* * * * *